US008233653B2

(12) United States Patent
Giese et al.

(10) Patent No.: US 8,233,653 B2
(45) Date of Patent: Jul. 31, 2012

(54) RECEIVER FACILITY WITH A MOVEABLE RECEIVER

(75) Inventors: Ulrich Giese, Erlangen (DE); Maja Serman, Buckenhof (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 286 days.

(21) Appl. No.: 12/579,546

(22) Filed: Oct. 15, 2009

(65) Prior Publication Data

US 2010/0098277 A1 Apr. 22, 2010

(30) Foreign Application Priority Data

Oct. 22, 2008 (DE) ..... 10 2008 052 682

(51) Int. Cl.
*H04R 25/00* (2006.01)

(52) U.S. Cl. ..... 381/322; 381/328

(58) Field of Classification Search ..... None
See application file for complete search history.

(56) References Cited

U.S. PATENT DOCUMENTS 5,636,285 A * 6/1997 Sauer ..... 381/314
5,701,348 A * 12/1997 Shennib et al. ..... 381/328
6,359,993 B2 * 3/2002 Brimhall ..... 381/328
6,473,513 B1 * 10/2002 Shennib et al. ..... 381/328
6,860,362 B2 3/2005 Saltykov
7,139,404 B2 * 11/2006 Feeley et al. ..... 381/330
2002/0006209 A1 1/2002 Mahoney et al.
2004/0165743 A1 * 8/2004 Bayer ..... 381/330
2006/0239488 A1 10/2006 Geschiere et al.
2007/0036379 A1 2/2007 Anderson

FOREIGN PATENT DOCUMENTS

EP 2026605 A1 2/2009

* cited by examiner

*Primary Examiner* — Yuwen Pan
*Assistant Examiner* — Taunya McCarty

(57) ABSTRACT

The wearing comfort and acoustics in an external receiver, in particular in a cymba hearing device, are to be improved. A receiver facility with a receiver, which is embodied to convert the electrical signals into acoustic signals, and an earpiece, which adjusts to an auditory canal when the hearing apparatus is being worn, are thus proposed. A base part is also provided, to which the earpiece is fastened and to which the receiver is moveably fastened at least in respect of a section of the base part. The mobility of the receiver relative to the earpiece decouples the wearing function of the earpiece relative to a centering function in respect of the receiver, as a result of which the wearing comfort and acoustics are improved.

16 Claims, 3 Drawing Sheets

RECEIVER FACILITY WITH A MOVEABLE RECEIVER

CROSS REFERENCE TO RELATED APPLICATIONS

This application claims priority of German application No. 10 2008 052 682.7 filed Oct. 22, 2008, which is incorporated by reference herein in its entirety.

FIELD OF THE INVENTION

The present invention relates to a receiver facility for a hearing apparatus with a receiver, which is embodied to convert the electrical signals into acoustic signals, and an earpiece, which adjusts to an auditory canal when the hearing apparatus is being worn. Furthermore, the present invention relates in particular to a behind-the-ear hearing device and/or a cymba hearing device with a receiver facility of this type. The term hearing apparatus is understood here to mean any device which can be worn on the head or ear, in particular a hearing device, headset, earphones and suchlike.

BACKGROUND OF THE INVENTION

Hearing devices are wearable hearing apparatuses which are used to assist the hard-of-hearing. In order to accommodate numerous individual requirements, various types of hearing devices are available such as behind-the-ear hearing devices (BTEs), hearing device with an external receiver (RIC: receiver in the canal) and in-the-ear hearing devices (ITE), for example also concha hearing devices or completely-in-the-canal hearing devices (ITE, CIC). The hearing devices listed as examples are worn on the outer ear or in the auditory canal. Bone conduction hearing aids, implantable or vibrotactile hearing aids are also available on the market. In these devices damaged hearing is stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or more microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

Hearing devices with an external receiver have to be embodied such that the receiver is arranged as centrally as possible in the auditory canal during wear. On the other hand, the wearing comfort is reduced and the acoustic characteristics of the device are faulty. With cymba hearing devices, in which the main body of the device including the microphone and signal processing is inserted into the cymba of the concha, the cable to which the external receiver is connected is also used for stabilization purposes. This means that on the one hand the cable exerts forces onto the main body of the hearing device and on the other hand onto the external receiver. This results in the receiver being pressed repeatedly against the wall of the auditory canal, since the earpiece (dome), which is designed to hold the receiver in the auditory canal, consists of relatively soft material. The earpiece is therefore too soft to be able to absorb the forces of the wire and/or cable. The receiver then rests eccentrically in the auditory canal, which, in some circumstances, may result in a significant deterioration of feedback problems.

This problem of the receiver only resting eccentrically in the auditory canal in certain cases was previously not recognized. It was in fact assumed that a standard earpiece centers the receiver precisely in the auditory canal. The situation is somewhat better with so-called active ear mold pieces, which are individually adjusted to the auditory canal. However even these are moved out of their precise position as result of the cable forces, so that problems relating to the centricity of the receiver develop.

SUMMARY OF THE INVENTION

The object of the present invention thus consists in providing a hearing facility, the receiver of which can be better centered in the auditory canal. Furthermore, provision is also to be made for a BTE hearing device and a cymba hearing device, the external receiver of which can likewise be better centered in the auditory canal.

This object is achieved in accordance with the invention by a receiver facility for a hearing apparatus comprising a receiver, which is embodied to convert the electrical signals into acoustic signals, and a ear piece, which adjusts to an auditory canal when the hearing apparatus is being worn, as well as a base part, to which the earpiece is fastened and to which the receiver is moveably fastened in respect of a section of the base part.

Using the receiver facility according to the invention, it is advantageously possible to essentially decouple the forces acting on the earpiece of the receiver facility away from the receiver. The receiver can as a result be positioned centrically in the auditory canal up to a certain degree irrespective of the ear mold, so that it does not press against the auditory canal wall. Increased wearing comfort and improved acoustic properties of the device are produced as a result.

According to one embodiment, for receiving electrical signals the receiver has an electrical cable, with the cable being fastened in or on the base part and the receiver being fastened exclusively to the cable. As a result, the elasticity of the cable can be used to forcibly decouple the receiver from the earpiece.

The base part can also have a bendable bar, to which the receiver is fastened. This is then particularly advantageous if the rigidity of the receiver cable is not sufficiently high to suitably position the receiver in the auditory canal. The bar may be embodied here such that a cable of the receiver passes therethrough. A more robust design compared with the variant in which the receiver is fastened by means of the cable alone is therefore produced.

A shell, in which the receiver is fastened, can also be arranged at the end of the bar on the receiver side. This shell can stabilize the receiver and relieve strain on the cable.

The base part is preferably embodied in one piece. This reduces assembly costs.

According to a further embodiment, the base part can comprise a first and a second part, which are connected to one another by a ball joint, with the earpiece being fastened to the first part and the receiver being fastened to the second part. If the ball joint has sufficient friction, a defined alignment of the receiver prior to insertion of the receiver facility into the auditory canal can take place without this alignment being accidentally changed during insertion.

Furthermore, a recess can be formed through the ball joint, in which recess a cable of the receiver passes. This measure in turn allows the cable to be protected. Inventive receiver facilities of this type can be used in particular for BTE hearing devices and cymba hearing devices, which have external receivers.

SUMMARY OF THE INVENTION

The present invention is now described in more detail below with reference to the appended drawings, in which.

DETAILED DESCRIPTION OF THE INVENTION

The exemplary embodiments shown in more detail below represent preferred embodiments of the present invention.

Figure 1:
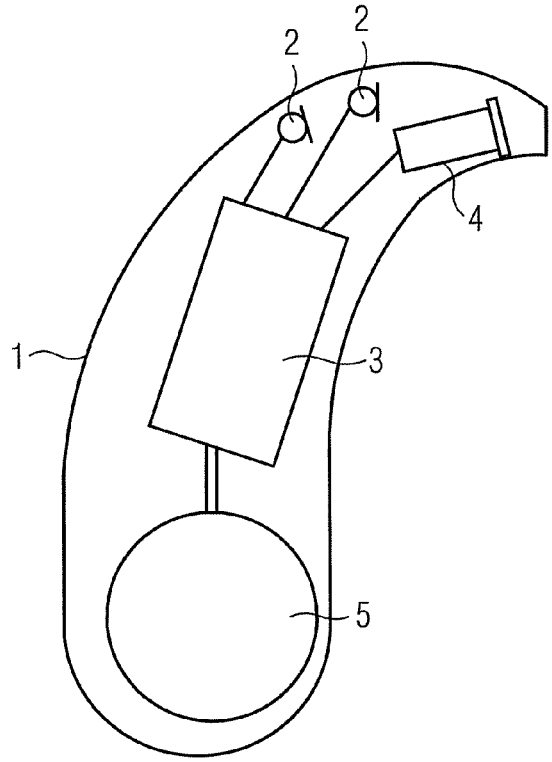
FIG 1 (Prior art)
FIG. 1 shows a basic drawing of a hearing device according to the prior art.
Figure 2:
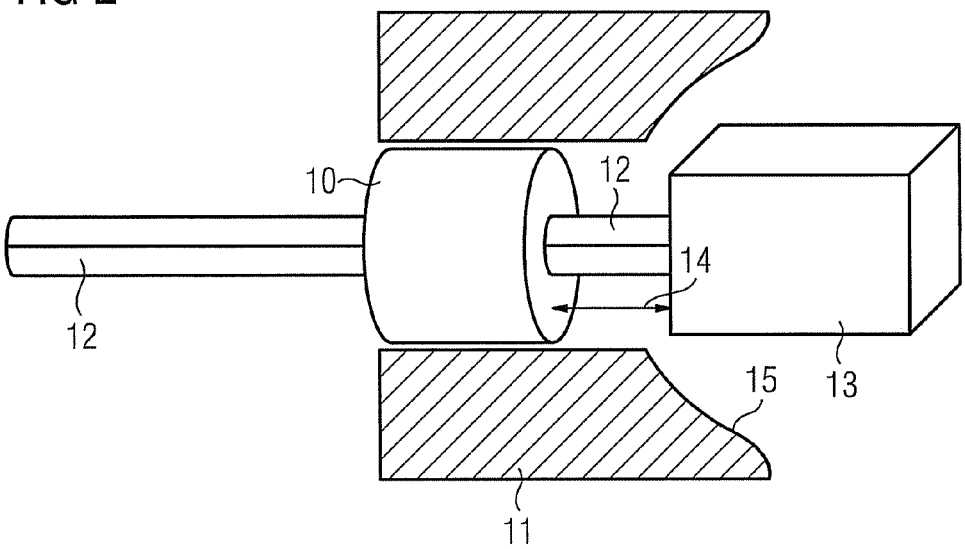
FIG. 2 shows a first embodiment of a cross-section through an inventive receiver facility.

The cross-section shown in FIG. 2 through a receiver facility according to a first embodiment shows a base part 10. This base part is embodied here cylindrically and in the present example has a diameter of approximately 2 mm. An elastic earpiece 11 is clipped onto the outer casing of the base part 10. This earpiece 11 (dome) adjusts to the auditory canal wall when being worn in the auditory canal. In the present example, the wall thickness of the hollow cylindrical earpiece increases towards a front face.

A cable 12, which supplies a receiver 13 with corresponding electrical signals, passes through the base part 10. To indicate the proportions, the receiver 13 is shown here as a cuboid and has a height of likewise approximately 2 mm. It is connected at a specific distance 14 to the base part 10 by way of the cable 12 alone.

The cable 12 has a casing and/or coating which can consist of the same material as the base part 10. A desired flexibility and/or rigidity of the cable 12 is produced as a result of this material and a suitable material thickness. Consequently, the receiver 13 can move to a certain degree relative to the base part 10. This degree is finally limited in the present example by a funnel-shaped recess 15 in the earpiece 11, which effects the reduction in the material thickness of the earpiece 11 toward the receiver 13 and acts in an acoustically amplifying fashion in certain frequency ranges.

The cable piece between the base part 10 and the receiver 13 does not rigidly connect these two components with one another, but renders them moveable relative to one another. This moveable connecting piece allows the receiver to follow a curvature in the auditory canal to a certain degree irrespective of the earpiece.

Figure 3:
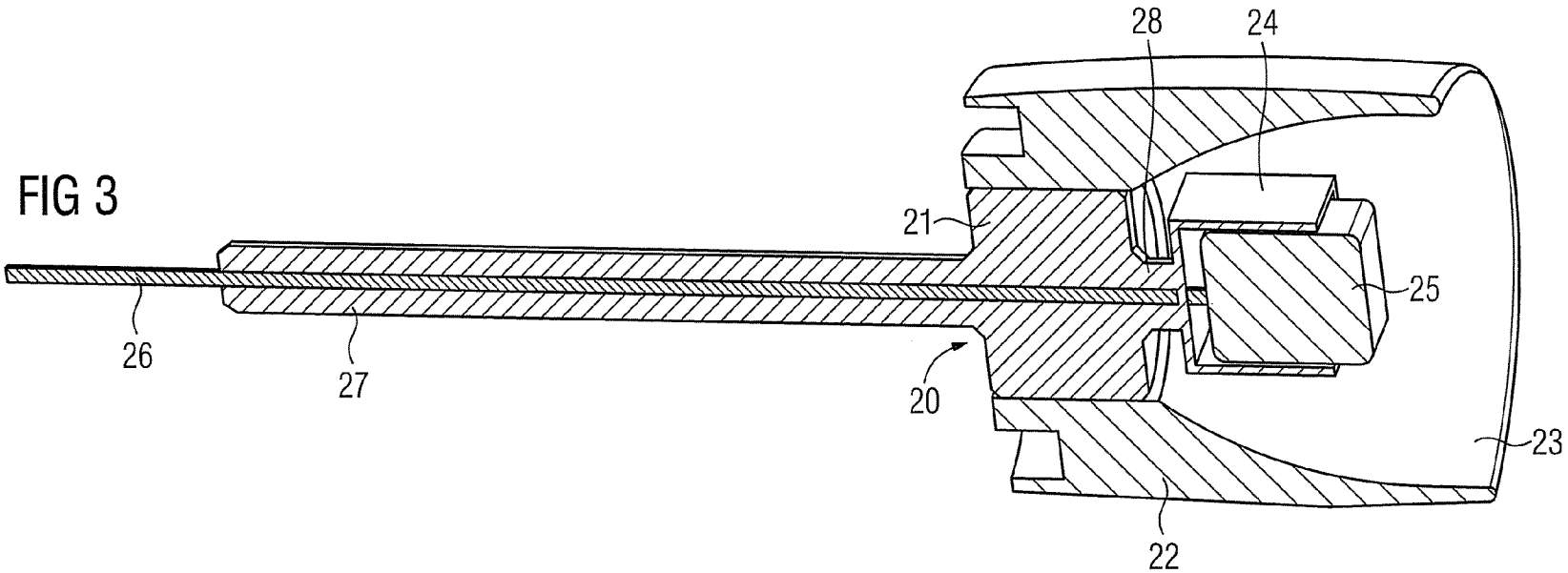
FIG. 3 shows a second embodiment of a cross-section through a receiver facility.

FIG. 3 shows a cross-section through a receiver facility according a second embodiment. It is apparent that the base part 20 is embodied here in one piece. It has a first section 21, which is also embodied here cylindrically and an earpiece 22 with a funnel-shaped recess 23 is clipped on the outer circumference thereof, like in the example in FIG. 2. A receiver 25 is fastened in a second section 24 of the base part 20. The second section 24 is embodied here in the manner of a shell and mostly surrounds the receiver 25. A cable 26 of the receiver 25 is guided through both sections 21 and 24 of the base part 20. In the direction facing away from the receiver 25, i.e. in the direction pointing out of the auditory canal when the receiver facility is being worn, the first section 21 is continued in one piece as a cable casing 27 and/or as a strain relief. The cable casing 27 and/or the strain relief can naturally be formed in two pieces with the base part.

The base part 20 has a bar 28 between the first section 21 and the second section 24. The cable 26 of the receiver 25 passes through this bar 28. The bar 28 is relatively thin compared with the first section 21 and the second section 24 in terms of its outer dimensions so that the two sections 21 and 24 are moveable to a certain degree relative to one another. By contrast the receiver 25 is rigidly fixed in the second section 24. The mobility between the first section 21, to which the earpiece 22 is fastened, and the receiver 25 is therefore also determined in this exemplary embodiment by the base part 20 itself. The bar 28 of the base part 20 in particular influences the mobility of the receiver 25, while in the example in FIG. 2, only the cable 12 influences the mobility of the receiver 13. The bar 28 can be dimensioned depending on the desired flexibility and/or can be manufactured from a suitable material.

Figure 4:
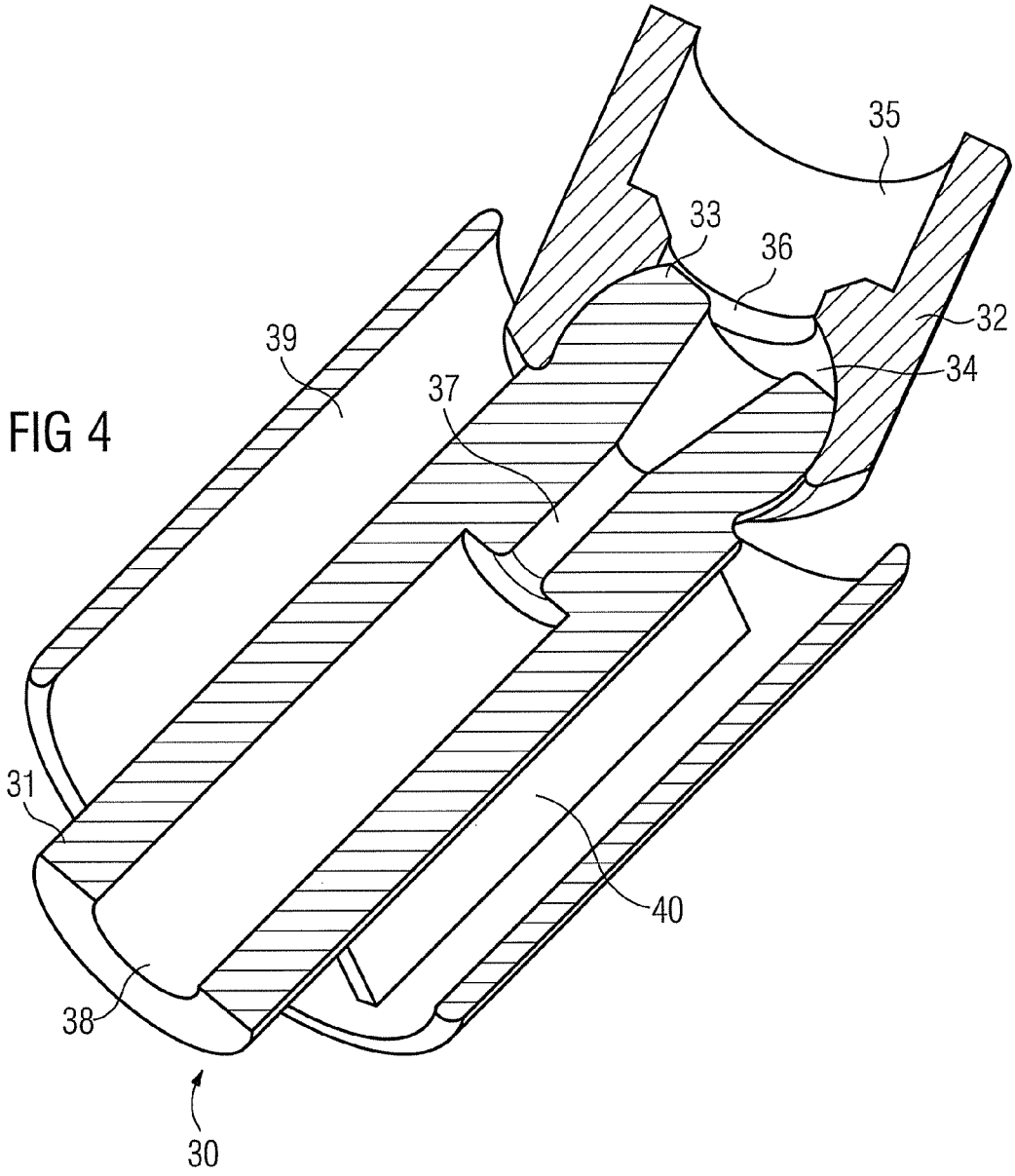
FIG. 4 shows a third embodiment of a cross-section through a receiver facility.

A further exemplary embodiment of an inventive receiver facility is reproduced in FIG. 4 in a cross-section. The base part 30 consists here of two pieces, a first part 31 and a second part 32. Both are connected to one another by way of a ball joint, with a ball section 33 being molded to the first part 31 and a ball section 34 being molded to the second part 32. This ball joint allows both parts 31 and 32 to be aligned to one another in a desired manner within a certain frame. A recess 35 for a receiver is provided in the second part 32, which is shown here for overview purposes. The second part 32 also exhibits a passage 36, through which a cable of the receiver can be guided outwards towards the second part 31. For cable guidance, the second part 31 has a bore 37, which conically enlarges toward the second part 32 within the region of the ball section 33. A cylindrical recess 38 is also shown in the first part 31, in which electronics systems (e.g. amplifiers) can be accommodated if applicable. A cylindrical earpiece 39 is clipped onto the first part 31, like also in the examples in FIGS. 2 and 3. In this example the earpiece 39 has very thin walls and the connection with the first part 31 of the base part 30 is produced by several bars 40.

The receiver is in turn forcibly decoupled from the earpiece with the ball joint. While the earpiece and/or the first part 31 of the base part 30 is used to support the hearing device system in and/or on the auditory canal, the second part 32, which can be aligned in a certain region by way of the ball joint, is used to centre the receiver in the auditory canal. The support function of the earpiece is therefore also decoupled here from the centering function in respect of the receiver in the receiver facility. Contrary hereto, as mentioned, with receiver facilities according to the prior art, the support function of the hearing system and the centering function in respect of the external receiver unit can be combined with one another since the wire and the rigid receiver facility per se implement both functions in combination. The inventive receiver which can be moved in the receiver facility now produces improved wearing comfort and optimized acoustics.

The invention claimed is:

1. A receiver device for a hearing apparatus, comprising:

a receiver to convert an electrical signal into an acoustic signal;

an earpiece adjustable to an auditory canal of a user when the hearing apparatus is worn by the user;

a base part comprising a first base section having an outer portion configured to engage the earpiece and provide mechanical support to the earpiece, the base part further comprising a second base section including a hollow shell to house the receiver;

a bendable bar defining a narrow neck region relative to the respective widths of the first and second base sections, the bendable bar arranged to flexibly interconnect the first and second base sections of the base part, wherein the first base section is flexibly moveable with respect to the receiver housed in the hollow shell of the second base section by way of the bendable bar.

2. The receiver device of claim 1, wherein the first base section, the second base section and the interconnecting bendable bar comprise one integral structure.

3. The receiver device of claim 1, wherein the first base section further comprises a cable casing section extending in a direction facing away from the receiver, the cable casing section configured to house at least a longitudinal portion of a signal-carrying cable coupled to the receiver.

4. The receiver device of claim 3, wherein the cable casing section comprises one integral structure with the first base section, the second base section and the interconnecting bendable bar.

5. The receiver device of claim 1, wherein the earpiece defines a funnel-shaped recess configured to reduce a thickness of the earpiece and provide a varying gap with respect to the receiver.

6. The receiver device of claim 5, wherein the funnel-shaped recess is further configured to acoustically amplify at least a predefined frequency range of the acoustic signal from the receiver.

7. The receiver device as claimed in claim 3, wherein the cable passes through the bendable bar.

8. A hearing device, comprising:

a housing;

a microphone arranged in the housing to record an ambient sound and generate a microphone signal;

a signal processing unit integrated in the housing to process the microphone signal;

a receiver to convert the processed microphone signal to an acoustic signal;

an earpiece adjustable to an auditory canal of a user when the hearing device is worn by the user;

a base part comprising a first base section having an outer portion configured to engage the earpiece and provide mechanical support to the earpiece, the base part further comprising a second base section including a hollow shell to house the receiver;

a bendable bar defining a narrow neck region relative to the respective widths of the first and second base sections, the bendable bar arranged to flexibly interconnect the first and second base sections of the base part, wherein the first base section is flexibly moveable with respect to the receiver housed in the hollow shell of the second base section by way of the bendable bar.

9. The hearing device of claim 8, wherein the first base section, the second base section and the interconnecting bendable bar comprise an integral structure.

10. The hearing device of claim 8, wherein the first base section further comprises a cable casing section extending in a direction facing away from the receiver, the cable casing section configured to house at least a longitudinal portion of a signal-carrying cable coupled to the receiver.

11. The hearing device of claim 10, wherein the cable casing section comprises one integral structure with the first base section, the second base section and the interconnecting bendable bar.

12. The hearing device of claim 8, wherein the earpiece defines a funnel-shaped recess configured to reduce a thickness of the earpiece and provide a varying gap with respect to the receiver.

13. The hearing device of claim 12, wherein the funnel-shaped recess is further configured to acoustically amplify at least a predefined frequency range of the acoustic signal from the receiver.

14. The hearing device as claimed in claim 8, wherein the hearing device is a behind-the-ear hearing device.

15. The hearing device as claimed in claim 8, wherein the hearing device is a cymba hearing device.

16. A receiver device for a hearing apparatus, comprising:

a receiver to convert an electrical signal into an acoustic signal;

an earpiece adjustable to an auditory canal of a user when the hearing apparatus is worn by the user;

a base part comprising a first part and a second part mechanically connected to one another by way of a ball joint, the second part including a recess to receive the receiver;

wherein the first part includes a bore having a width configured to conically increase as the bore extends towards the second part, wherein the first part further includes a cylindrical recess coupled to the bore and configured to accommodate at least one electrical component and/or electrical system of the hearing apparatus in an interior of the first part, wherein the first part is alignable with respect to the receiver in the recess of the second part by way of a freedom of movement provided by the ball joint.

* * * * *